US009739123B2

(12) United States Patent
Wheeler et al.

(10) Patent No.: US 9,739,123 B2
(45) Date of Patent: Aug. 22, 2017

(54) DUAL INJECTION POINTS IN SAGD

(75) Inventors: Thomas J. Wheeler, Houston, TX (US); David A. Brown, Katy, TX (US); Tawfik N. Nasr, Katy, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 182 days.

(21) Appl. No.: 13/424,080

(22) Filed: Mar. 19, 2012

(65) Prior Publication Data

US 2012/0247760 A1 Oct. 4, 2012

Related U.S. Application Data

(60) Provisional application No. 61/468,731, filed on Mar. 29, 2011.

(51) Int. Cl.
*E21B 43/24* (2006.01)

(52) U.S. Cl.
CPC ..... *E21B 43/2406* (2013.01)

(58) Field of Classification Search
USPC ..... 166/272.7
See application file for complete search history.

(56) References Cited

U.S. PATENT DOCUMENTS

| | | | | |
|---|---|---|---|---|
| 4,008,764 | A | 2/1977 | Allen | |
| 4,572,294 | A | 2/1986 | Duerksen et al. | |
| 4,577,691 | A | 3/1986 | Huang et al. | |
| 4,700,779 | A | 10/1987 | Huang et al. | |
| 4,850,429 | A | 7/1989 | Mims et al. | |
| 5,273,111 | A * | 12/1993 | Brannan et al. | 166/245 |
| 6,257,334 | B1 * | 7/2001 | Cyr et al. | 166/272.7 |
| 7,464,756 | B2 | 12/2008 | Gates et al. | |
| 7,527,096 | B2 | 5/2009 | Chung et al. | |
| 7,591,306 | B2 | 9/2009 | Hocking | |
| 2003/0131989 | A1 * | 7/2003 | Zakiewicz | 166/245 |
| 2005/0211434 | A1 | 9/2005 | Gates et al. | |
| 2006/0243448 | A1 * | 11/2006 | Kresnyak et al. | 166/303 |
| 2007/0095536 | A1 | 5/2007 | Vinegar et al. | |
| 2007/0095537 | A1 | 5/2007 | Vinegar | |
| 2008/0017372 | A1 * | 1/2008 | Gates et al. | 166/254.1 |
| 2009/0188661 | A1 * | 7/2009 | Bizon | 166/52 |
| 2009/0272532 | A1 * | 11/2009 | Kuhlman | 166/268 |

(Continued)

FOREIGN PATENT DOCUMENTS

| | | |
|---|---|---|
| WO | 2010087898 | 8/2010 |

OTHER PUBLICATIONS

PCT International Search Report, PCT/US12/29751, and Written Opinion dated Jun. 14, 2012, 8 pages.

*Primary Examiner* — Anuradha Ahuja
(74) *Attorney, Agent, or Firm* — ConocoPhillips Company

(57) ABSTRACT

A method for recovering petroleum from a formation, wherein at least two injection wells and at least one production well are in fluid communication with said formation, comprising: introducing a gaseous mixture into a first and a second injection well at a temperature and a pressure, wherein said gaseous mixture comprises steam and non-condens able gas (NCG); and recovering a fluid comprising petroleum from said production well, wherein said injection wells and a production well are horizontal wells, and wherein said first injection well is disposed 1-10 meters above said production well, and said second injection well is disposed at least 5 meters above said first injection well.

20 Claims, 8 Drawing Sheets

(56) References Cited

U.S. PATENT DOCUMENTS

| | | | | |
|---|---|---|---|---|
| 2010/0108318 | A1* | 5/2010 | Diehl et al. | 166/272.3 |
| 2010/0163229 | A1 | 7/2010 | Nenniger | |
| 2010/0206555 | A1* | 8/2010 | Menard et al. | 166/245 |
| 2010/0326656 | A1 | 12/2010 | Menard | |

* cited by examiner

DUAL INJECTION POINTS IN SAGD

CROSS-REFERENCE TO RELATED APPLICATIONS

This application is a non-provisional application which claims the benefit of and priority to U.S. Provisional Application Ser. No. 61/468,731 filed Mar. 29, 2011, entitled "Dual Injection Points in SAGD," which is hereby incorporated by reference in its entirety.

FEDERALLY SPONSORED RESEARCH STATEMENT

Not applicable.

FIELD OF THE INVENTION

The invention relates to petroleum production, in particular to an in situ processing method for heavy oil and/or bitumen production.

BACKGROUND OF THE INVENTION

Production of heavy oil and bitumen from a subsurface reservoir can be quite challenging. Initial viscosity of the oil at reservoir temperature is often greater than a million centipoise (cP). Because of this high viscosity oil cannot be pumped out of the ground using typical methods, and it often must be mined or processed in situ. Surface mining is limited to reservoirs to a depth of about 70 meters. Greater depths are not economical to access and most reserves are not accessible by the method. Since only a relatively small percentage of bitumen and oil sand deposits (such as the Athabasca oils sands of Alberta, Canada), are recoverable through open-pit mining, the majority of require some form of in situ extraction.

Steam-assisted gravity drainage (SAGD) is an in situ processing method first introduced by Roger Butler in 1973 as a means of producing heavy oil and bitumen. SAGD uses two parallel and superposed horizontal wells that are vertically separated by about 5 meters (See FIG. 1). First, steam is circulated in both wells to conductively heat the petroleum deposit between the well pair. The mobile petroleum is then gravity drained to the lower horizontal well. During drainage, steam is injected into the top horizontal well (injection well) and oil and condensate are produced from the lower horizontal well (production well).

As an in situ recovery process, SAGD requires on-site steam generation and water treatment, translating into expensive surface facilities. Since steam-to-oil ratios are high and natural gas is often used to generate steam, SAGD is expensive to operate. SAGD is very energy intensive largely because the reservoir rock and fluids must be heated enough to lower viscosity and mobilize the petroleum, and heat is lost to overburden and underburden, water and gas intervals above, below, and within the main pay section, and to the non-productive rock in the reservoir.

On average, a third of the energy is produced back with fluids in the reservoir, a third is lost to overburden and underburden, and a third is left behind in the reservoir after abandonment. The inefficiency results in a steam-to-oil ratio (SOR) of 3.0 (vol/vol), and a 50-60% recovery factor of the original bitumen. According to the Canadian National Energy Board, 34 $m^3$ of natural gas is needed to produce one barrel of bitumen from in situ projects, and about 20 $m^3$ for integrated projects. Nonetheless, since a barrel of oil equivalent (BOE) is about 170 $m^3$ of gas, this process still represents a large gain in energy. To compound these issues, however, heavy oil and bitumen are sold at significant discounts compared to oil product benchmarks, such as Western Texas Intermediate (WTI), providing an exceedingly challenging economic environment.

Attempts have been made to address the limitations of SAGD, for example, by co-injecting steam with non-condensable gases (NCGs), such as $CO_2$, flue or combustion gases, and light hydrocarbons. The NCG provides an insulating layer at the top of the steam chamber, resulting in higher thermal efficiency. Co-injection decreases the amount of steam needed to recover petroleum from a formation, thereby decreasing the steam-to-oil ratio. The NCG also increases pressure in the reservoir, promoting drainage of produced liquid to the production well.

Co-injection, however, has its own limitations. NCG breakthrough at the SAGD production well and reflux of the gas in the steam chamber suppress the rate of oil production. NCG breakthrough decreases the relative permeability of oil, thus limiting production (FIGS. 2 & 3). Gas reflux from draining fluids occurs close to the injection well region. Because of partial pressure effects of NCG, temperatures are lowered at the drainage interface, reducing the rate of oil production (FIG. 4). Slight changes in temperature can substantially affect solubility of NCG or light hydrocarbons, promoting reflux of co-injected fluids back into the steam chamber. These gases also tend to move towards the production well, increasing gas saturation and decreasing oil permeability near the production well. All these complications can diminish performance, delay production, and increase cost.

U.S. Pat. No. 4,008,764 describes a method for recovering viscous petroleum from a formation that has been penetrated by at least one production well and by at least one injection well, both wells being in fluid communication with the formation, comprising, among other things, introducing a gaseous mixture of carrier gas and solvent into a formation via the injection well, and recovering a produced fluid comprising formation petroleum. The inert carrier gas, for example $N_2$, air, ethylene, propylene, $CO_2$, $H_2S$, $H_2$, and/or anhydrous ammonia ($NH_3$), is gaseous at formation temperature and pressure. The solvent, for example paraffinic hydrocarbons and/or carbon disulfide ($CS_2$), is liquid at formation temperature and pressure. U.S. Pat. No. 4,008,764 fails to describe use of steam in the gaseous mixture.

U.S. Pat. No. 74,644,756 describes a method for recovering heavy hydrocarbons from an underground reservoir that has been penetrated by an injection well and a production well, comprising, among other things, injecting steam and a heavy hydrocarbon solvent into the injection well over time while producing reservoir hydrocarbons from the production well, and transitioning from steam and heavy hydrocarbon solvent injection to a lighter hydrocarbon solvent injection while continuing to produce hydrocarbons from the production well. U.S. Pat. No. 74,644,736 fails to describe use of NCG in a gaseous mixture or using more than one injection well.

U.S. Pat. No. 7,527,096 describes a method for extracting hydrocarbons from a reservoir, comprising, among other things, continuously injecting a solvent fluid into the reservoir through a first injection well, continually producing reservoir fluid from a second production well, and upon solvent fluid breakthrough at the second well, switching the roles of the two wells, such that the injection well becomes the production well, and vice versa. The solvent fluid can comprise steam, methane, butane, ethane, propane, pentanes, hexanes, heptanes, $CO_2$ and mixtures thereof. At least two horizontal wells can be disposed in the reservoir and perform injection or production functions simultaneously. U.S. Pat. No. 7,527,096 fails to describe the disposition of injection wells and production wells relative to each other.

US20080017372 describes a method for recovering heavy hydrocarbons from an underground reservoir containing heavy hydrocarbons, an injection well and a production well, comprising: injecting steam into the reservoir to form a steam vapor chamber; co-injecting predetermined quantities of NCG, hydrocarbon solvent and steam into the steam vapor chamber to maximize solubility of the solvent in the heavy hydrocarbons; recovering produced hydrocarbons within the production well; controlling the volume of the steam vapor chamber by progressively adjusting the volume of steam, NCG and hydrocarbon solvent injected into the reservoir, whereby the hydrocarbon solvent and NCG are predominant relative to the volume of steam, and recovering further produced heavy hydrocarbons. US20080017372 fails to describe two injection wells and their disposition relative to each other and to the production well. The application also states that it remains unclear what the optimal amount NCG is relative to injected steam.

What is lacking is a method to increase the efficiency of SAGD without introducing new problems, such as solvent reflux, gas breakthrough, delayed production, and the like.

SUMMARY OF THE INVENTION

The invention generally relates to a method to increase the efficiency of SAGD using two injections points, rather than the typical single injection point, and thus avoids introducing new problems, such as solvent reflux, gas breakthrough, delayed production, and the like. The two or more injection points increases efficiency by reducing solvent reflux and gas breakthrough at the production well. This limits increased gas saturation around the producer and increases relative permeability to oil and hence improved oil recovery.

By using two injection points within a steam chamber, solvent reflux and gas breakthrough at the production well can be avoided. The dual injections change gas flux profiles within the SAGD chamber. In some embodiments, a first injection well is placed 5 meters above the producer, and a second injection well is placed at least 5 meters above the first injection well. In other embodiments, injection wells can be a single wellbore with multilaterals placed 5 meters above the production well, and a second injection well placed at least 5 meters above the first injection well.

In particular, this application provides a method for recovering petroleum from a formation, wherein at least two injection wells and at least one production well are in fluid communication with said formation, comprising: introducing a gaseous mixture into a first and a second injection well at a temperature and a pressure, wherein said gaseous mixture comprises steam and non-condensable gas (NCG); and recovering a fluid comprising petroleum from said production well, wherein said injection wells and a production well are horizontal wells, and wherein said first injection well is disposed 1-10 meters above said production well, and said second injection well is disposed at least 5 meters above said first injection well.

Preferably, the first injection well can be disposed 5 meters above said production well. The injection and production wells can be vertically aligned or in near vertical alignment with each other. The first and second injection wells can be separate wells with separate vertical boreholes, or multilateral wells sharing a common wellbore.

The NCG can be selected from the group consisting of nitrogen, air, carbon dioxide, flue gas, combustion gas, hydrogen sulfide, hydrogen, anhydrous ammonia, and any mixture thereof. The gaseous mixture can further comprise a hydrocarbon solvent, for example a $C_1$-$C_4$ hydrocarbon, such as a $C_1$-$C_4$ hydrocarbon selected from the group consisting of methane, ethane, propane, butane, ethylene, propylene, and any mixture thereof or in another embodiment the hydrocarbon solvent is selected from a group consisting of: $C_1$, $C_2$, $C_3$, $C_4$, $C_5$, $C_6$, $C_7$, $C_8$, $C_9$, $C_{10}$, $C_{11}$, $C_{12}$ or any combinations thereof.

Generally, the NCG is less soluble in said petroleum than is said hydrocarbon solvent. NCG can comprise 1 to 40 vol % of said gaseous mixture.

The temperature can be 180-260° C., and the pressure can be from 1 MPa to 6 MPa. The gaseous mixture can be injected into said first injection well at a different temperature and/or as into said second injection well. The gaseous mixture can also be injected into said first injection well at the same temperature and/or pressure as into said second injection well.

In a particular embodiment, there is provided a method for recovering petroleum from a formation, wherein at least two injection wells and at least one production well are in fluid communication with said formation, comprising: introducing a gaseous mixture into a first and a second injection well at 180-260° C. and 1-6 MPa, wherein steam comprises 60-99 vol % of said gaseous mixture and said NCG comprises 1-40 vol % of said gaseous mixture; and recovering a fluid comprising petroleum from a production well, wherein said injection wells and said production well are horizontal wells, and wherein said first injection well is disposed 5 meters above said production well, and said second injection well is disposed at least 5 meters above the first injection well.

DESCRIPTION OF EMBODIMENTS OF THE INVENTION

Figure 1:
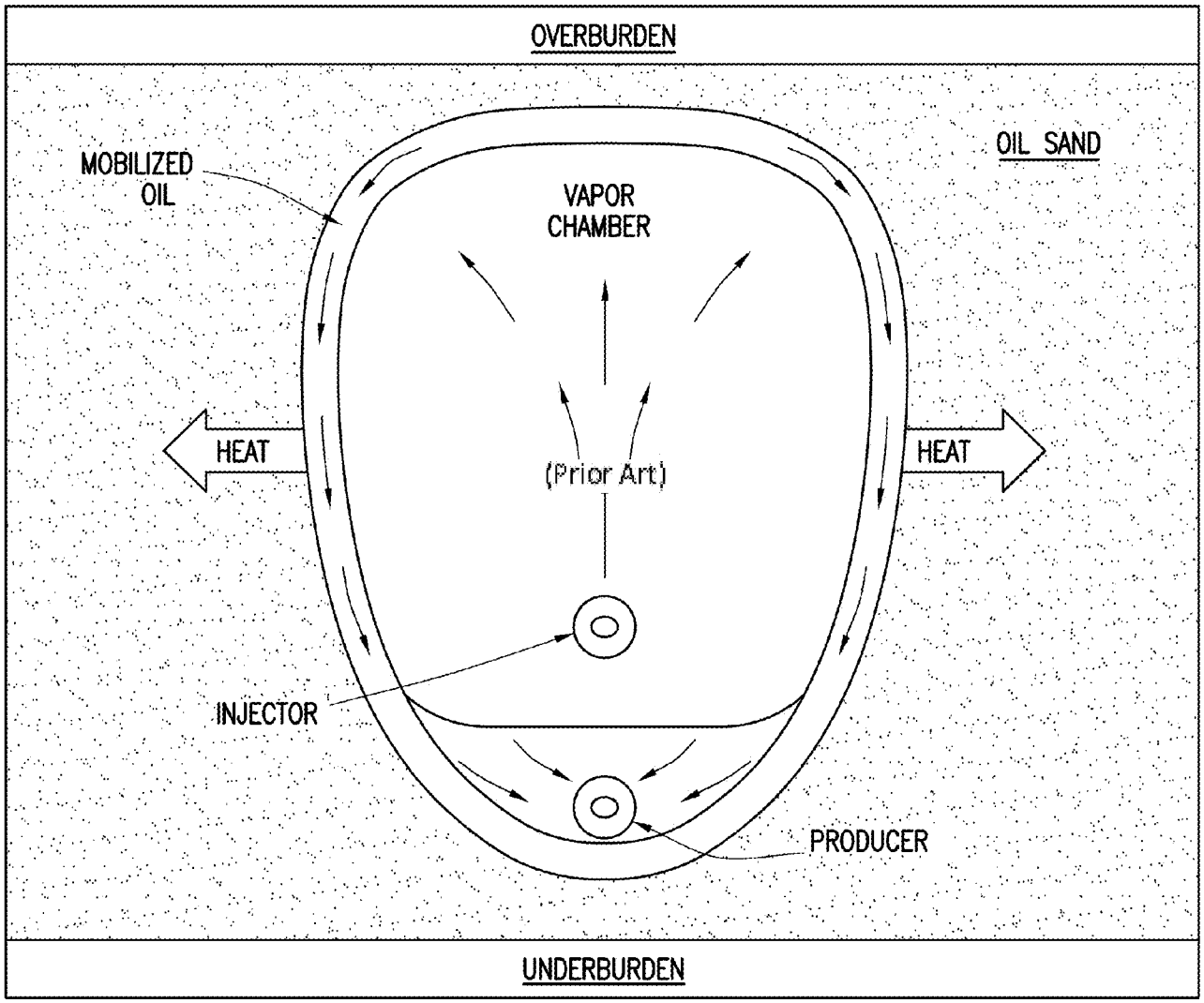
FIG. 1 (Prior Art)
FIG. 1 depicts a conventional steam-assisted gravity drainage in an oil sand formation.
Figure 2:
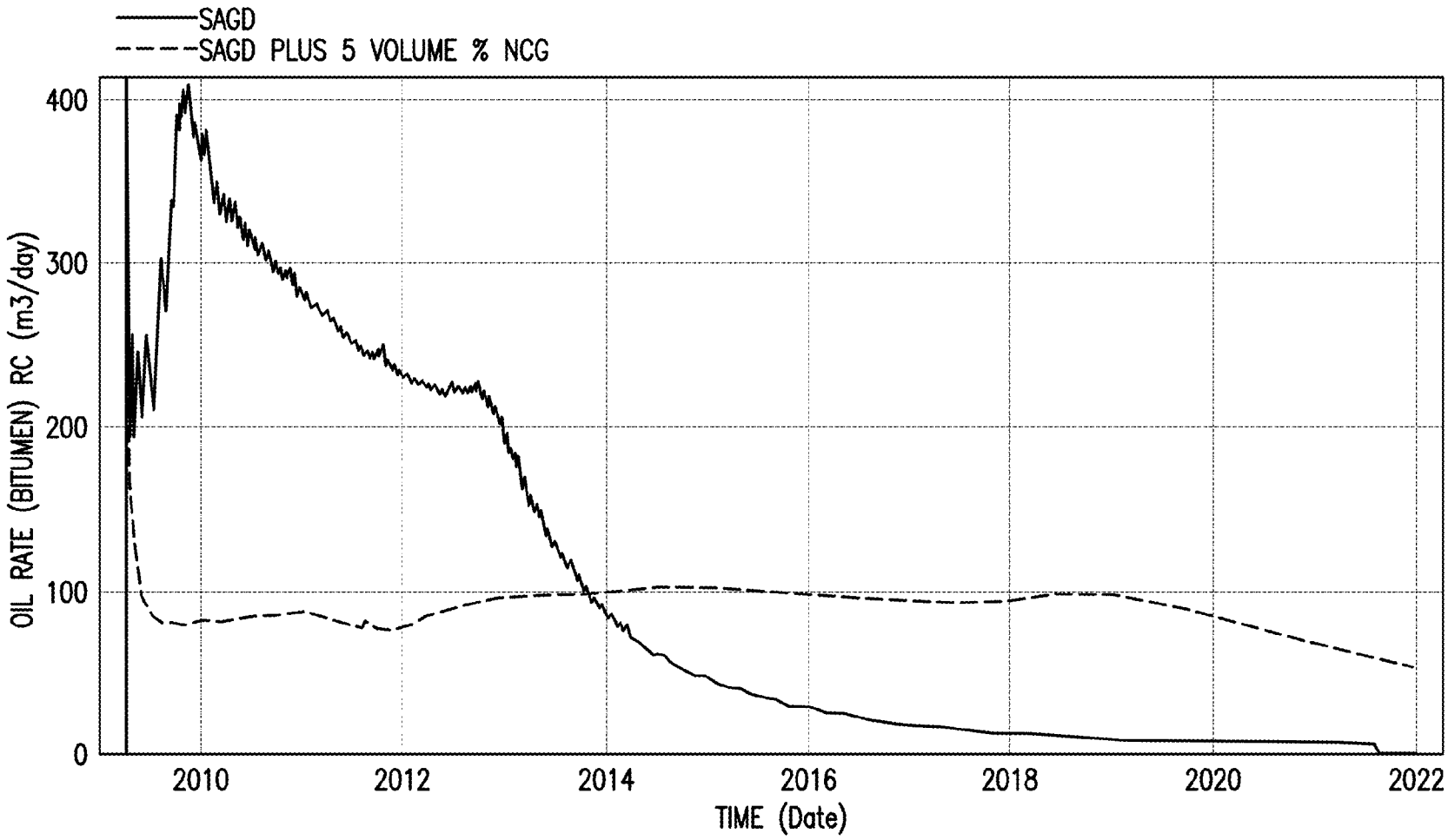
FIG. 2 compares oil production rates with and without non-condensable gas (NCG) co-injection.
Figure 3:
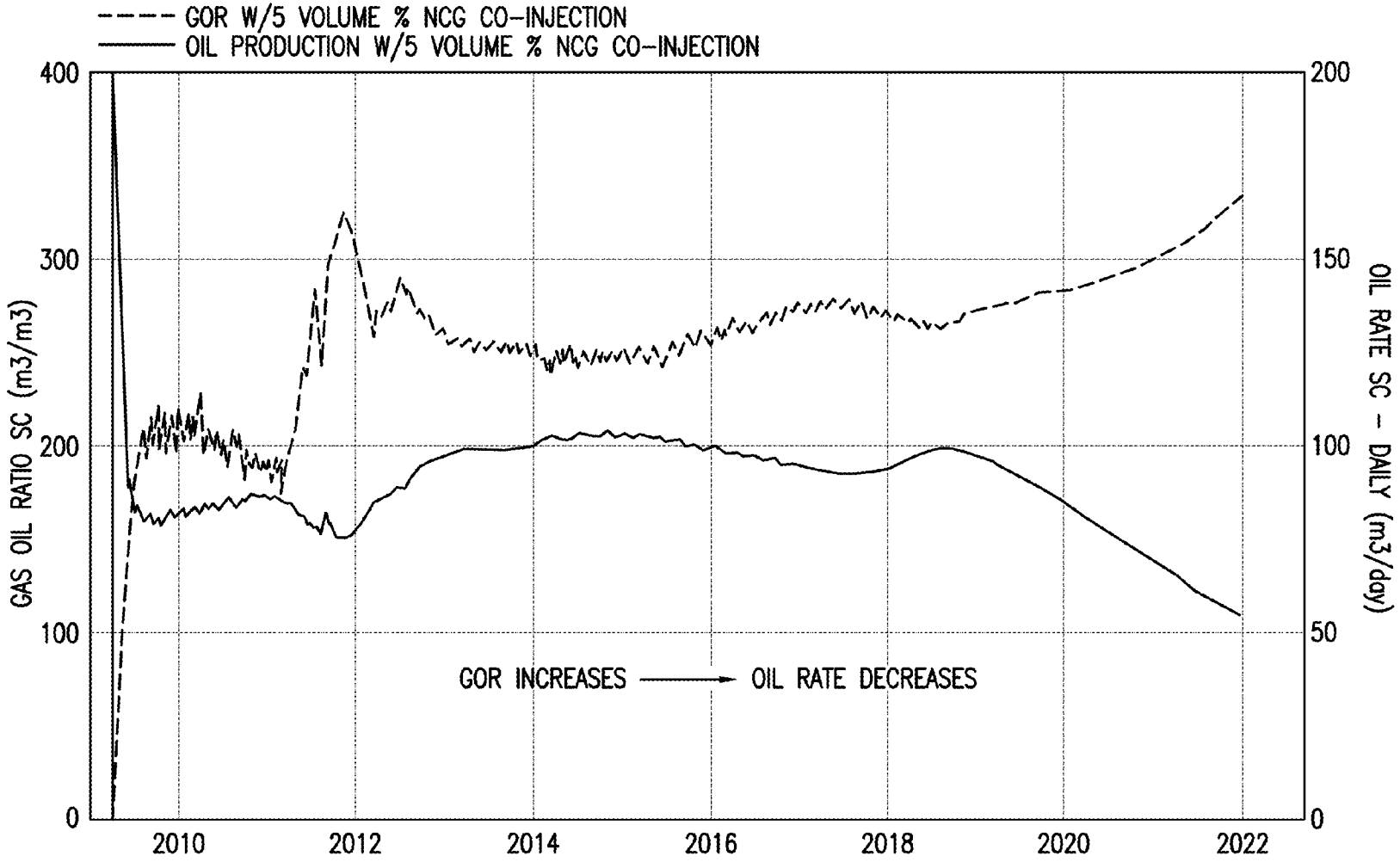
FIG. 3 shows gas-oil ratio (GOR) influence on oil production rate.
Figure 4:
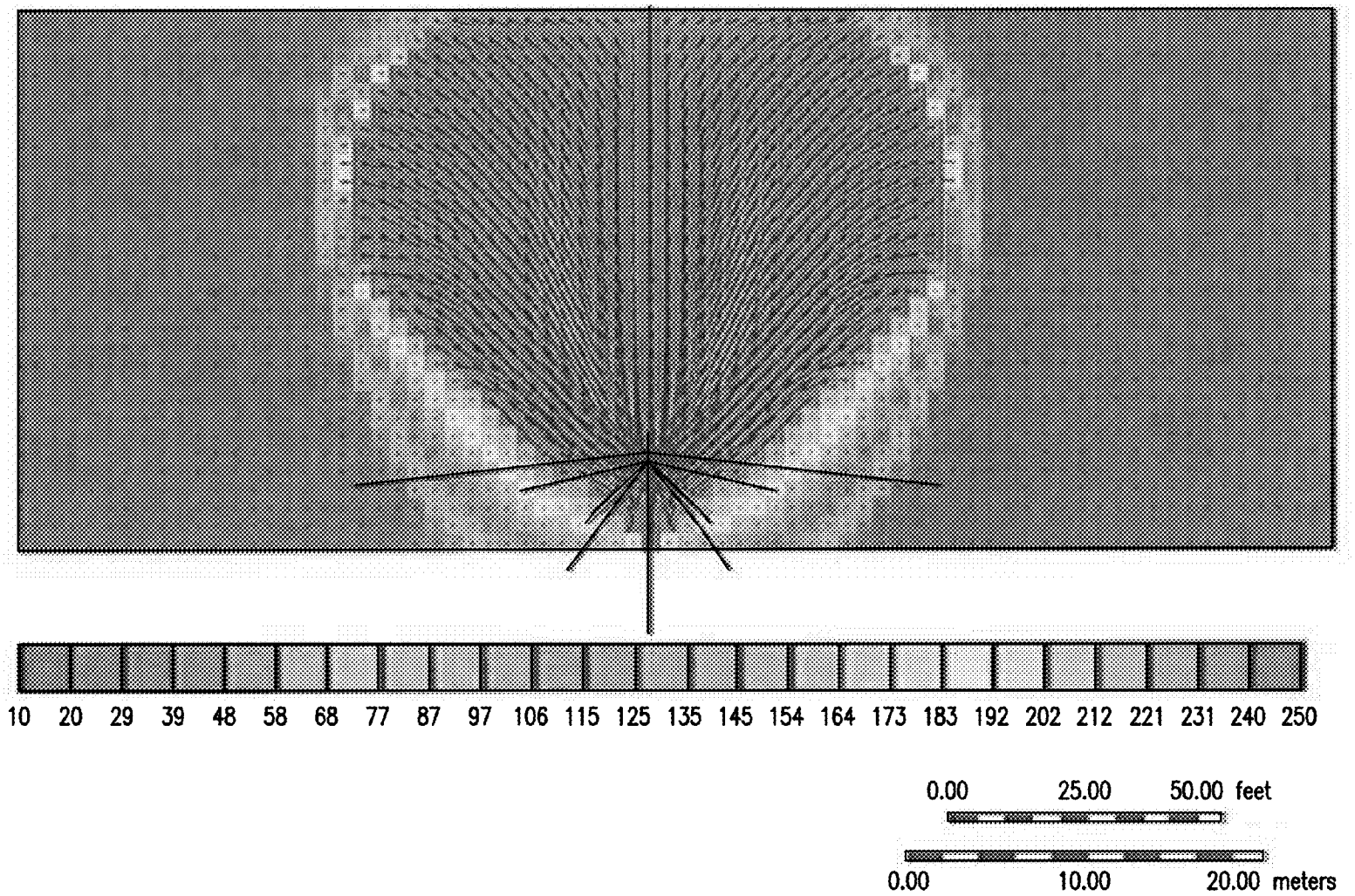
FIG. 4 shows a conventional SAGD using a steam-only chamber. Gas flux vectors indicate steam movement in the chamber with no gas flux from the chamber walls back to the producer.
Figure 5:
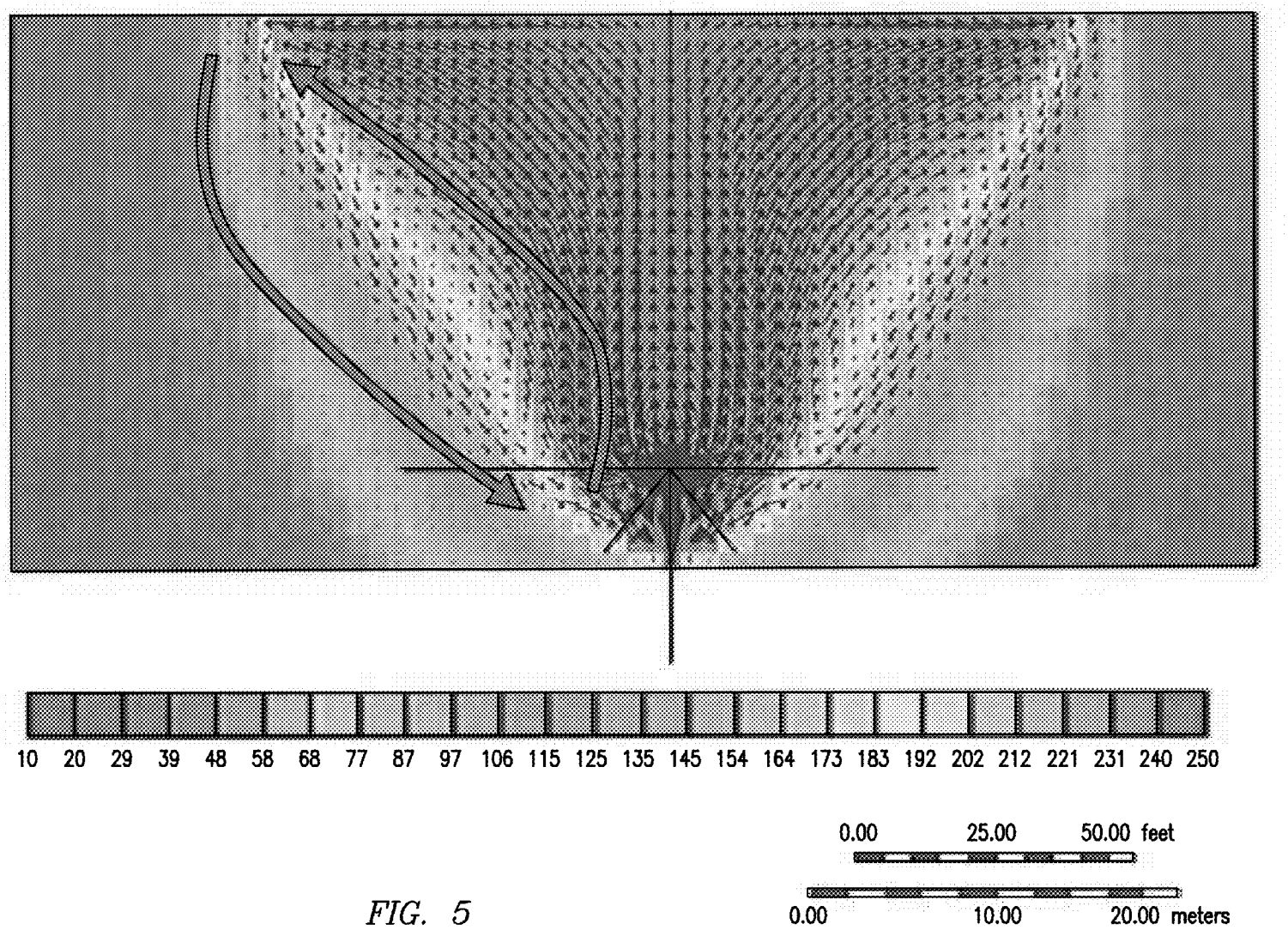
FIG. 5 shows SAGD with a 5 vol % NCG. Note that as temperature increases fluids move back toward the injector, and that fluxes of free gas phase around the injector (gas recycle).

The following abbreviations are used herein:

| | |
|---|---|
| BOE | barrel of oil equivalent |
| cP | centipoise |
| cSOR | cumulative steam-oil ratio |
| CWE | cold water equivalent |
| DSG | direct steam generation |
| GOR | gas-oil ratio |
| MPa | megapascals |
| SAGD | steam-assisted gravity drainage |
| SOR | steam-to-oil ratio |
| WTI | West Texas Intermediate |

"Formation" as used herein refers to a geological structure, deposit, reserve or reservoir which includes one or more hydrocarbon-containing layers, one or more non-hydrocarbon layer, an overburden and/or an underburden. The hydrocarbon layers can contain non-hydrocarbon material as well as hydrocarbon material. The overburden and underburden contain one or more different types of impermeable materials, for example rock, shale, mudstone wet carbonate, or tight carbonate.

"Petroleum deposit" refers to an assemblage of petroleum in a geological formation. The petroleum deposit can comprise light and heavy crude oils and bitumen. Of particular interest for the method described herein are petroleum deposits which primarily comprise heavy petroleum, such as heavy oil and petroleum.

"Injection well" or "injector" refers to a well into which a fluid is injected into a geological formation. The injected fluid can comprise, for example, a gaseous mixture of steam, NCG and/or hydrocarbon solvent. The injected fluid can also comprise a liquid solvent, such as a liquid hydrocarbon solvent or $CS_2$.

"Production well" or "producer" refers to a well from which a produced fluid is recovered from a geological formation. The produced fluid can comprise, for example, a petroleum product, such as heavy oil or bitumen.

"Horizontal drilling" refers to a process of drilling and completing a well, beginning with a vertical or inclined linear bore, which extends from the surface to a subsurface location in or near a target reservoir (e.g., gas, oil), then bears off at an arc to intersect and/or traverse the reservoir at an entry point. Thereafter, the well continues at a horizontal or nearly horizontal attitude tangent to the arc, substantially or entirely remaining within the reservoir until the desired bottom hole location is reached. (Of course, the "bottom hole" of a horizontal well is the terminus of the horizontal wellbore rather than the gravitational bottom of the vertical wellbore.)

A "horizontal well" is a well produced by horizontal drilling. Horizontal displacements of more than 8000 feet (2.4 km) have been achieved. The initial linear portion of a horizontal well, unless very short, is typically drilled using rotary drilling techniques common to drilling vertical wells. A short-radius well has an arc with a 3-40 foot (1-12 m) radius and a build rate of as much as 3° per 100 feet (30 m) drilled. A medium-radius well has an arc with a 200-1000 foot (61-305 m) radius and build rates of 8-30° per 100 feet drilled. A long-radius well has an arc with a 1000-2500 (305-762 m) foot radius. Most new wells are drilled with longer radii, while recompletions of exiting wells tend to employ medium or short radii. Medium-radius wells are the most productive and most widely used.

Horizontal wells confer several benefits. Operators are often able to develop a reservoir with fewer horizontal wells than vertical wells, since each horizontal well can drain a larger rock volume about its bore than a vertical well could. One reason for this benefit is that most oil and gas reservoirs are more extensive in their horizontal (area) dimensions than in their vertical (thickness) dimension. A horizontal well can also produce at rates several times greater than a vertical well, due to a higher wellbore surface area within the producing interval.

In some embodiments, the injection and production wells are vertically aligned or in near vertical alignment with each other. Of course, additional injection and production wells can be used and the placement can be varied accordingly, for example 3, 4 or 5 injection wells, and 2, 3 or 4 production wells. The placement need not be exact, and can vary according to convenience, surface structures, subsurface impediments, and available equipment and/or technology. Thus, placement of parallel, perpendicular, or vertically aligned wells, etc., is only a rough description.

In some embodiments, the first and second injection wells can be multilateral wells, wherein each is connected to the same vertical well bore, but branches horizontally at different intervals. "Multilateral well" refers to a well, which is one of a plurality of horizontal branches, or "laterals", from a vertical wellbore. Such wells have at least two such branches and allow access to widely spaced reservoir compartments from the same wellbore, thus saving the cost of drilling multiple vertical wellbores and increasing the economy of oil and gas extraction. For example, a well with a fishbone configuration has a single vertical wellbore and a plurality of non-vertical (e.g., horizontal), deviated portion connected to the vertical wellbore and extending into the formation. The non-vertical portions of a fishbone-configured well can further progress through the reservoir at angles different from the original angle of deviation.

"Ex situ processing" refers to petroleum processing which occurs above ground. Oil refining is typically carried out ex situ.

"In situ processing" refers to processing which occurs within the ground in the reserve itself. Processes include heating, pyrolysis, steam cracking, and the like. In situ processing has the potential of extracting more oil from a given land areas than ex situ processes since they can access material at greater depths than surface mines can. An example of in situ processing is SAGD.

"Steam-assisted gravity drainage" or "SAGD" refers to an in situ recovery method which uses steam to assist in situ processing, including related or modified processes such as steam-assisted gravity push (SAGP), and the original SAGD method as described by Butler in U.S. Pat. No. 4,314,485. In general, the method requires two horizontal wells drilled into a reservoir. The wells are drilled vertically to different depths within the reservoir then, using direction drilling, the wells are extended horizontally, resulting in horizontal wells vertically aligned to and spaced from each other. Typically the production well is located above the base of the reservoir but as close as possible to its bottom, for example between 1 and 3 meters above the base of the oil reserve. The injection well is placed above (or nearly above) the production well, and is supplied steam from the surface. The steam rises, forming a steam chamber that slowly grows toward the reservoir top, thereby increasing reservoir temperature and reducing viscosity of the petroleum deposit. Gravity pulls the petroleum and condensed steam through the reservoir into the production well at the bottom, where the liquid is pumped to the surface. At the surface, water and petroleum can be separated from each other.

In a SAGD process, steam can be co-injected with NCG and/or hydrocarbon solvent. "Non-condensable gas" or "NCG" refers to a chemical that remains in the gaseous phase under process conditions. For example, NCGs used during in situ processing at a petroleum deposit remain gaseous throughout the process, including under the conditions found in the fossil fuel deposit. Examples of suitable NCGs include, but are not limited to, carbon dioxide ($CO_2$), nitrogen ($N_2$), carbon monoxide (CO), and flue gas. "Flue gas" or "combustion gas" refers to an exhaust gas from a combustion process that exits to the atmosphere via a pipe or channel. Flue gas can typically comprises nitrogen, $CO_2$, water vapor, oxygen, CO, nitrogen oxides ($NO_x$) and sulfur oxides ($SO_x$). The combustion gases can be obtained by direct steam generation (DSG), reducing the steam-oil ratio and improving economic recovery. An NCG can be injected in a 1 to 40 vol %. Pressures can be between 1 MPa and 6 MPa. Temperatures can be 180-276° C. Typically, NCG does not substantially dissolve in the petroleum deposit.

In one embodiment the heating of the petroleum deposit can be done entirely by steam. In other embodiments it is possible for the heating of the petroleum deposit be aided or supplemented by other forms of heating in addition to steam. In one embodiment it is possible for the heating to be accomplished by 90%, 80%, 70%, 60%, 50%, 40%, 30%, or even 20% of steam. Examples of other forms of heating that can be used to supplement or aid the heating of the steam include microwave, radio frequency, chemical, radiant, electrical and other methods commonly known to one skilled in the art.

"Direct steam generation" refers to a generator for directly generating steam. Typically direct steam generators include a combustion zone, a plurality of mixing zones downstream from the combustion zone, and an exhaust barrel downstream from the mixing zones. As an example, a direct steam generator such as that described in U.S. Pat. No. 6,206,684 (assigned to Clean Energy Systems and incorporated herein by reference in its entirety) can be used or modified.

"Hydrocarbon solvent" refers to a chemical consisting of carbon and hydrogen atoms which is added to another substance to increase it fluidity and/or decrease viscosity. A hydrocarbon solvent, for example, can be added to a fossil fuel deposit, such as a heavy oil deposit or bitumen, to partially or completely dissolve the material, thereby lowering its viscosity and allowing recovery. The hydrocarbon solvent can have, for example, 1 to 12 carbon atoms ($C_1$-$C_{12}$) or 1 to 4 carbon atoms ($C_1$-$C_4$). A $C_1$ to $C_4$ hydrocarbon solvent, includes methane, ethane, propane and butane. The hydrocarbon solvent can be introduced into a petroleum deposit as a gas or as a liquid. Under the pressures of the petroleum deposit, the hydrocarbon solvent may condense from a gas to a liquid, especially if the hydrocarbon solvent has 2 or more carbon atoms.

"Cumulative steam-oil ratio" or "cSOR" refers to the ratio of cumulative injected steam (expressed as cold water equivalent, CWE) to cumulative petroleum production volume. The thermal efficiency of SAGD is reflected in the cSOR. Typically a process is considered thermally efficient if its SOR is less than 3, such as 2 or lower. A cSOR of 3.0 to 3.5 is usually the economic limit, but this limit can vary project to project.

"Steam chamber", "vapor chamber" or "steam vapor chamber" refers to the pocket or chamber of gas and vapor formed in a geological formation by a SAGD or SAGP process. A steam chamber can be in fluid communication with one or more injection wells, for example, two injection wells. During initiation of a SAGD process, overpressurized conditions can be imposed to accelerate steam chamber development, followed by prolonged underpressurization to reduce the steam-to-oil ratio. Maintaining reservoir pressure while heating advantageously minimizes water inflow to the heated zone and to the wellbore. When petroleum is continuously recovered and the cSOR is under 4, a steam chamber has likely formed. A cSOR of less than 4 implies that heat from the injected steam reaches the petroleum at the edges of the chamber and that the mobilized bitumen is flowing under gravity to the production well.

"Recovery" refers to extraction of petroleum from a petroleum deposit or hydrocarbon-containing layer within a geologic formation.

The present invention is exemplified with respect to in situ processing of a heavy oil/and bitumen reservoir using two injection wells and one production well. However, this method is exemplary only, and the invention can be broadly applied to any fossil fuel deposit and different numbers and combinations of injection and production wells can be used. The following examples are intended to be illustrative only, and not unduly limit the scope of the appended claims.

Example 1

SAGD with Dual Injection Wells

By using a first injection well placed 5 meters above the production well, and a second injection well placed at least 5 meters above the first injection well, the system of wells performed significantly better than to a single injection well set up.

The second injection well can be placed at any height above the first injection well, as long as it is below the top of the formation. In one embodiment the second injection well is 10 to 15 meters above the first injection well. It is important to note that the injection wells and the production wells can be offset or non-aligned, as known by one skilled in the art.

Figure 6:
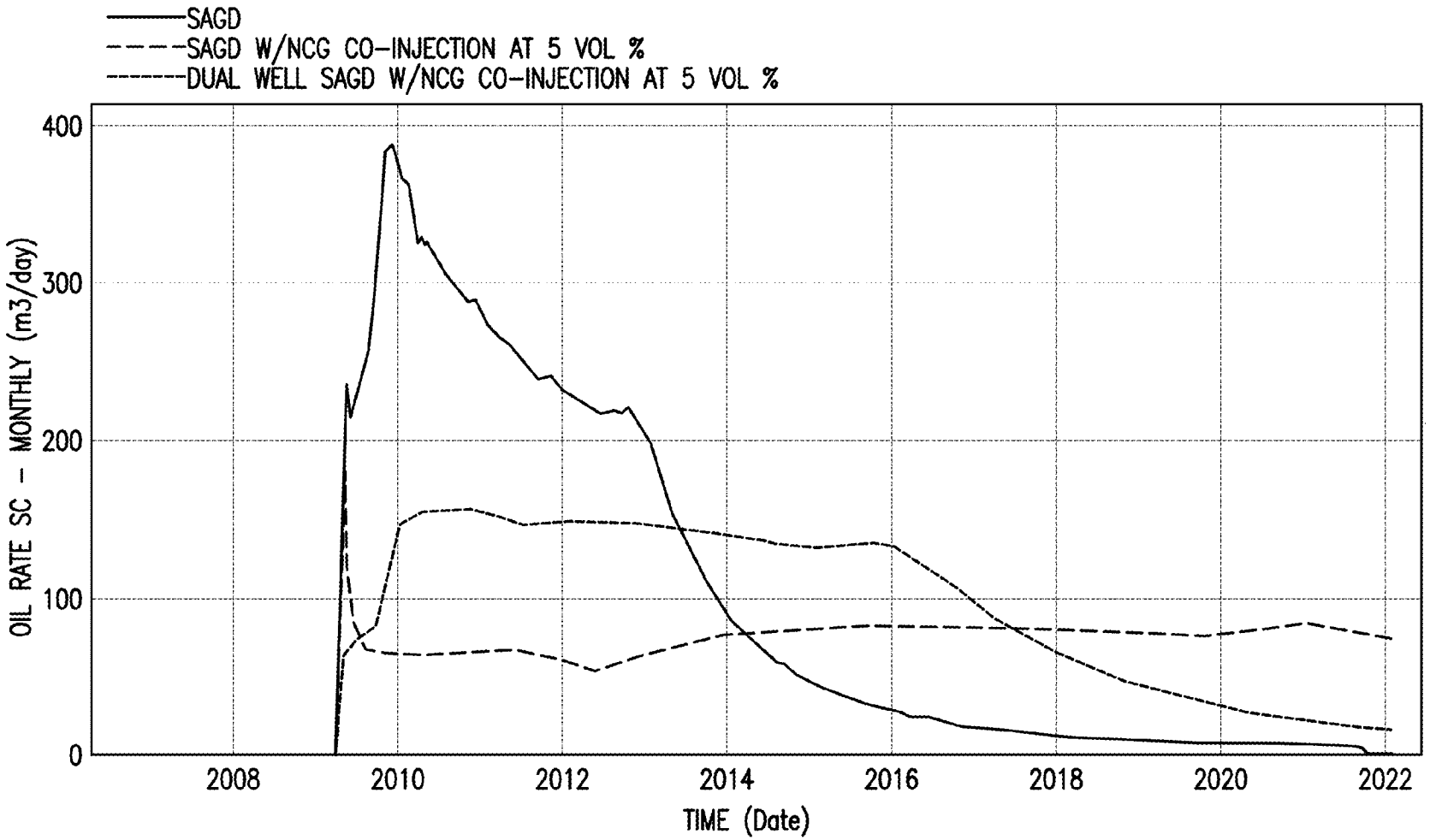
FIG. 6 plots rate of oil production, showing the improvement in average rate over the base SAGD NCG co-injection case when dual injection is employed.

FIG. 6 plots rate of oil production. The average rate is improved over the base SAGD NCG co-injection case when dual injection strategy is employed.

Figure 7:
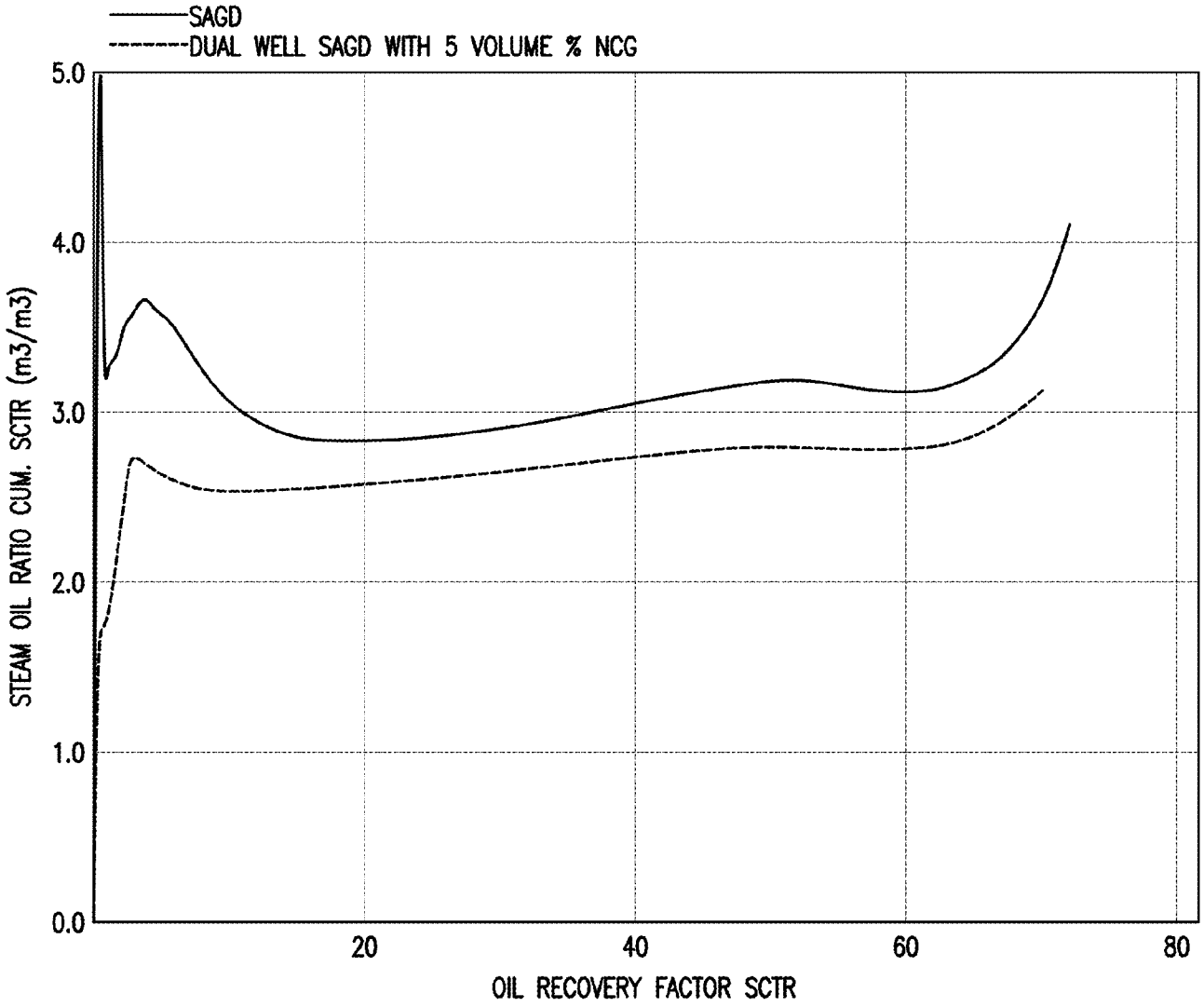
FIG. 7 shows the improvement in thermal efficiency gained through the dual well SAGD process versus a single injection well SAGD with NCG co-injection.

A significant improvement in energy efficiency is shown through an improved cSOR (FIG. 7). In this set of simulations, SAGD at 4 MPa shows an improvement of >15%. FIG. 7 also demonstrates that the improved thermal efficiency was maintained through the life of the process, thus improving the overall economics or recovery from the formation. Work was carried out using a numerical simulator (CMG STARS) to evaluate the potential benefits of using dual injection points on SAGD performance. An Athabasca oil sands reservoir of 100 m in width by 30 m in height by 850 m in length was used for the study. 850 m long horizontal producer was placed 1 m above the bottom of the oil bearing sands and in the middle, of the reservoir. Two 850 m long horizontal injectors were placed vertically above the producer and separated by 5-m and 10-m from the producer in the vertical direction.

Example 2

SAGD with Multilateral Injection Wells

Figure 8:
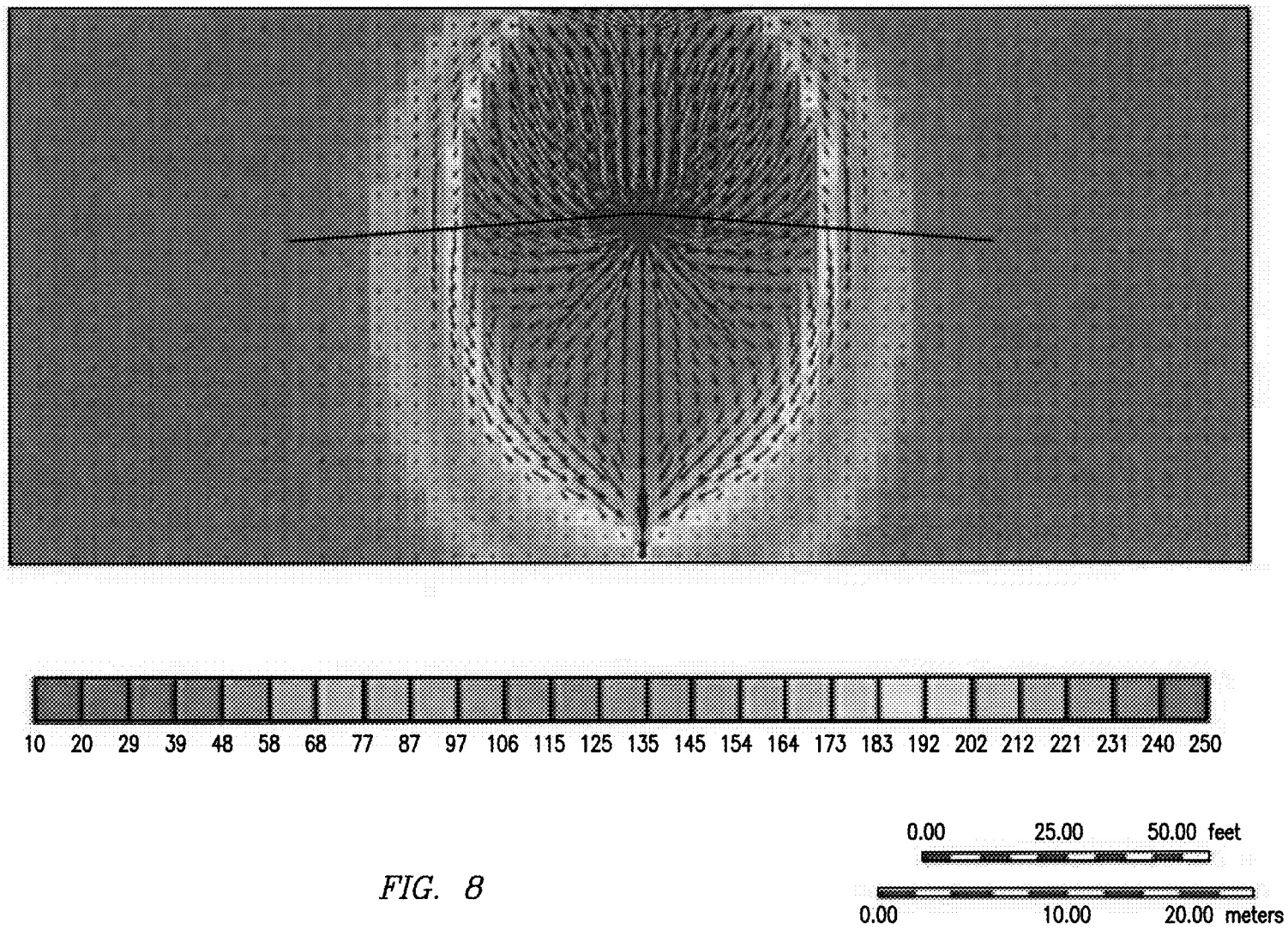
FIG. 8 shows dual injection well SAGD chamber development with 5 vol % NCG co-injection.

The injection wells can comprise a multilateral well, where the injection wells have a common vertical well bore with a first lateral placed 5 meters above the production well, and a second lateral placed at least 5 meters above the first lateral. It is important to note that the injection wells and the production wells can be offset or non-aligned, as known by one skilled in the art. This dual injector SAGD method concept substantially decreases gas reflux and allows the fluids to move into the production well instead. This movement, in turn, allows the chamber to develop into a classical SAGD shape, retaining the height and oil rate at higher levels while improving the thermal efficiency. Unlike previously reported methods, the shape of the steam chamber is no longer affected by refluxing NCG at the injection well (FIG. 8). Work was carried out using a numerical simulator (CMG STARS) to evaluate the potential benefits of using dual injection points on SAGD performance. An Athabasca oil sands reservoir of 100 m in width by 30 m in height by 850 m in length was used for the study. 850 m long horizontal producer was placed 1 m above the bottom of the oil bearing sands and in the middle, of the reservoir. Two 850 m long horizontal injectors were placed vertically above the producer and separated by 5-m and 10-m from the producer in the vertical direction.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The following references are incorporated by reference in their entirety:

U.S. Pat. No. 4,008,764.
U.S. Pat. No. 4,314,485.
U.S. Pat. No. 74,644,756.
U.S. Pat. No. 7,527,096.
US20080017372.

What is claimed is:

1. A method for recovering petroleum from a formation, comprising:

a. providing at least three wells, wherein the at least three wells comprise at least one horizontal injection well, a second injection well, and at least one horizontal production well, wherein the at least one horizontal injection well and the at least one horizontal production well are a horizontal well pair that are vertically aligned in said formation and are in fluid communication with said formation, b. introducing a gaseous mixture into the at least one horizontal injection well and the second injection well at a temperature and a pressure, wherein said gaseous mixture comprises steam and non-condensable gas (NCG); and c. recovering a fluid comprising petroleum from said at least one horizontal production well, wherein the at least one horizontal injection well is disposed 1-10 meters above the at least one horizontal production well, and the second injection well is disposed at least 5 meters above said at least one horizontal injection well within said formation wherein the pressure, temperature, and NCG introduced at the second injection well prevent refluxing, improve thermal efficiency, and reduce cumulative steam-oil ratio.

2. The method of claim 1, wherein said at least one horizontal injection well is disposed 5 meters above a production well.

3. The method of claim 1, wherein said at least one horizontal injection well and a production well are vertically aligned with each other.

4. The method of claim 1, wherein said NCG is selected from the group consisting of nitrogen, air, carbon dioxide, flue gas, combustion gas, hydrogen sulfide, hydrogen, anhydrous ammonia, and any mixture thereof.

5. The method of claim 1, wherein said NCG is obtained from direct steam generation.

6. The method of claim 1, wherein said gaseous mixture further comprises a hydrocarbon solvent.

7. The method of claim 6, wherein said hydrocarbon solvent is selected from the group consisting of methane, ethane, propane, butane, ethylene, propylene, and any mixture thereof.

8. The method of claim 6, wherein said NCG is less soluble in said petroleum than is said hydrocarbon solvent.

9. The method of claim 1, wherein said temperature is 180-260° C.

10. The method of claim 1, wherein said pressure is 1-6 MPa.

11. The method of claim 1, wherein said NCG comprises 1 to 40 vol % of said gaseous mixture.

12. The method of claim 1, wherein said gaseous mixture is injected into said at least one horizontal injection well at a different temperature, pressure, or temperature and pressure than into said second injection well.

13. The method of claim 1, wherein said gaseous mixture is injected into said at least one horizontal injection well at the same temperature, pressure, or temperature and pressure as into said second injection well.

14. The method of claim 1, wherein said at least one horizontal injection well and said second injection well are multilateral wells sharing a common wellbore.

15. A method for recovering petroleum from a formation, comprising:

a. providing at least three wells, wherein the at least three wells comprise at least one horizontal injection well, a second injection well, and at least one horizontal production well, wherein the at least one horizontal injection well and the at least one horizontal production well are a horizontal well pair that are vertically aligned in said formation and are in fluid communication with said formation, b. introducing a gaseous mixture into the at least one horizontal injection well and the second injection well at 180-260° C. and 1-6 MPa, wherein steam comprises 60-99 vol % of said gaseous mixture and a non-condensable gas (NCG) comprises 1-40 vol % of said gaseous mixture; and c. recovering a fluid comprising petroleum from the at least one horizontal production well, wherein the at least one horizontal injection well is disposed 5 meters above the at least one horizontal production well, and the second injection well is disposed at least 5 meters above the at least one horizontal injection well within said formation wherein pressure, temperature, and the NCG introduced at the second injection well prevent refluxing, improve thermal efficiency, and reduce cumulative steam-oil ratio.

16. The method of claim 15, wherein said at least one horizontal injection well and a production well are vertically aligned with each other.

17. The method of claim 15, wherein said NCG is selected from the group consisting of nitrogen, air, carbon dioxide, flue gas, combustion gas, hydrogen sulfide, hydrogen, anhydrous ammonia, and any mixture thereof.

18. The method of claim 15, wherein said gaseous mixture further comprises a hydrocarbon solvent selected from the group consisting of methane, ethane, propane, butane, ethylene, propylene, and any mixture thereof.

19. The method of claim 18, wherein said NCG is less soluble in petroleum than is said hydrocarbon solvent.

20. The method of claim 18, wherein said at least one horizontal injection well and said second injection well are multilateral wells sharing a common wellbore.

* * * * *